US006458245B1

(12) United States Patent
Höglund et al.

(10) Patent No.: US 6,458,245 B1
(45) Date of Patent: Oct. 1, 2002

(54) CTMP-PROCESS

(75) Inventors: Hans Höglund, Matfors; Roland Bäck, Njurunda; Ove Danielsson, Stockholm; Bo Falk, Järfälla, all of (SE)

(73) Assignee: SCA Research AB, Sundsvall (SE)

( * ) Notice: Subject to any disclaimer, the term of this patent is extended or adjusted under 35 U.S.C. 154(b) by 1134 days.

(21) Appl. No.: 08/754,110

(22) Filed: Nov. 22, 1996

Related U.S. Application Data

(62) Division of application No. 08/337,420, filed on Nov. 7, 1994, now Pat. No. 5,607,546, which is a continuation of application No. 07/910,307, filed as application No. PCT/SE91/00091 on Feb. 11, 1991, now abandoned.

(30) Foreign Application Priority Data

Feb. 13, 1990 (SE) ..... 9000515

(51) Int. Cl.[7] ..... D21H 11/02

(52) U.S. Cl. ..... 162/149; 162/100

(58) Field of Search ..... 162/25, 26, 28, 162/17, 19, 55, 83–84, 149, 78, 100

(56) References Cited

U.S. PATENT DOCUMENTS

| | | | | |
|---|---|---|---|---|
| 2,425,024 A | | 8/1947 | Beveridge et al. | |
| 3,388,037 A | | 6/1968 | Asplunde et al. | |
| 3,423,282 A | | 1/1969 | Rerolle et al. | |
| 3,627,629 A | | 12/1971 | Miller | |
| 3,865,685 A | | 2/1975 | Hebbel et al. | |
| 4,486,267 A | | 12/1984 | Prusas | |
| 4,756,798 A | | 7/1988 | Lachenal et al. | |
| 4,776,926 A | | 10/1988 | Lindahl | |
| 4,922,989 A | * | 5/1990 | Backlund et al. | 162/26 |
| 4,938,843 A | * | 7/1990 | Lindhal | 162/55 |

FOREIGN PATENT DOCUMENTS

| | | |
|---|---|---|
| AU | 26798/88 | 8/1989 |
| CA | 1122358 | 5/1982 |
| CA | 1164157 | 3/1984 |
| NZ | 194407 | 2/1983 |
| NZ | 199486 | 12/1984 |
| NZ | 217718 | 3/1989 |
| SE | 215417 | 9/1967 |
| SE | 385719 | 7/1976 |
| SE | 397851 | 11/1977 |
| SE | 404044 | 9/1978 |

OTHER PUBLICATIONS

"Millar Western Launches Plans for Second BCTMP Mill In Saskatchewan", Pulp & Paper, May, 1990, by K. Patrick, pp. 75–78.

(List continued on next page.)

*Primary Examiner*—Geoffrey L. Knable
(74) *Attorney, Agent, or Firm*—Young & Thompson

(57) ABSTRACT

An absorbent, chemithermomechanical pulp produced from lignocellulosic material with a wood yield above 88%, a low resin content <0.15%, a long fibre content above 70%, a short fibre content below 10% and a shive content below 3. The method for producing the pulp comprises the steps of impregnating, preheating, defibering, and washing the material. The impregnation and preheating of the chips are effected in one and the same vessel over a combined time period of a most 2 minutes, particularly at most 1 minute, preferably at most 0.5 minutes; using a warm impregnating liquid having a temperature of at least 100° C., suitably at least 130° C. and preferably having essentially the same temperature as in the preheating process; and preheating the chips at a temperature of 150–175°C., preferably 160–170° C. Defibering is carried out with an energy input which is at most half of the energy input required for defibering when the preheating and defibering are carried out at 135° C.

3 Claims, 6 Drawing Sheets

OTHER PUBLICATIONS

"Chemimechanical Pulp (CMP) from Mixtures of Aspen and Larch: the Effects of Cooking Conditions, Mixture Composition, and the Method of Mixing", Tappi Journal, Jun., 1990, by S. Lo et al., pp. 213–218.
"Energy Considerations in CTMP Expansions for Board Mills", Tappi Journal, Jan., 1991, by K. Knoernschild et al., pp. 145–150.
"Alkaline Peroxide Mechanical Pulping of Hardwoods", Tappi Journal, Jun., 1991, by C. Cort et al., pp. 79–84.
"Fibreco BCTMP Mill Construction Nears Completion at Taylor, B.C.", Pulp & Paper, Jun., 1988, by M. Ducey, pp. 62–67.
"BCTMP Special Report, The World of Market BCTMP", Pulp & Paper Special Report, by P. Sharman, pp. S1–S32.
"Refiner Hydrogen Peroxide Bleaching of Thermomechanical Pulps", Tappi Journal, May, 1988, by P. Sharpe et al., pp. 109–113.
"Chemithermomechanical Pulp from Mixed High–Density Hard–woods", Tappi Journal, Jul., 1988, by M. Miller et al., pp. 145–146.
"Fast Growth Ahead for Aspen CTMP", PPI, Mar. 1990, by I. Croon, pp. 36, 37 and 55.
"Mechanical Pulp Bleaching Survey Explores New Equipment Technology", Pulp & Paper, Jun., 1989, by M. Ducey, pp. 130–133.
"Millar Western Bleached CTMP Mill Approaching Startup at Whitecourt", Pulp & Paper, Jan. 1988, by K. Patrick, pp. 80–84.
"Donohue Matane Bleached CTMP Mill to Focus Marketing on Euorpe, U.S.", Pulp & Paper, Oct., 1989, by D. Garcia, pp. 136–138.
"How CTMP Can Improve 'Woodfree' Paper", PPI, Feb., 1988, by R. Cockram, pp. 65–66.
"Inpacel Studies the Export Markets", PPI, May, 1990, by P. Knight, pp. 85–86.
"Millar Western Prepared its New Mill", PPI, May, 1990, by M. Castagne, pp. 128–132.
"Sphinx Reveals its Market Secrets", PPI, Jun., 1988, by J. Pearson, pp. 57 and 59.
"Chubut Plans Folding Boxboard Mill", PPI, by P. Kauppi et al., two pages.
"Pulping Processes", Sven A. Rydholm, Interscience Publishers, 1965, pp. 304–305.

* cited by examiner

CTMP-PROCESS

This application is a division of application Ser. No. 08/337,420, filed Nov. 7, 1994, now U.S. Pat. No. 5,607,546 which is a file wrapper continuation of Ser. No. 07/910,307, filed Jul. 22, 1992, under 35 U.S.C. §371, and now abandoned which was the National stage of PCT/SE91/00091, filed Feb. 11, 1991.

FIELD OF THE INVENTION

The present invention relates to an absorbent chemithermomechanical pulp and to a method of manufacturing the same.

BACKGROUND OF THE INVENTION

Hitherto, it has only been possible to apply the process of defibering chips with a low energy input subsequent to preheating the chips under high pressure and high temperature (150–170° C.), the so-called Asplund process, within the board manufacturing industry, since the pulp resulting from this process is dark in colour and cannot be bleached at reasonable chemical consumptions. Furthermore, the fibres become coated with a lignin skin and are therefore stiff and rigid, which results in poorer strength and absorption properties. Consequently, it has only been possible to produce chemithermomechanical pulp (CTMP) of high brightness and good absorbency by preheating and refining at a temperature of at most 140° C. High brightness is especially important when producing tissue pulp.

DE-A-27 14 730 describes a process for producing a chemically modified thermomechanical pulp where the wood material is preheated at a temperature of 135–200° C. during 1–30 minutes. The time used according to the examples is of the order of 10 minutes. To obtain the desired flexibility an energy input of twice the normal is required.

SUMMARY OF THE INVENTION

The object of the present invention is to provide a chemithermomechanical pulp which exhibits a low resin content, an extremely high long-fibre content, an extremely low short-fibre content, and an extremely low shive content. Such pulps are particularly suited for the manufacture of fluff and tissue. The extremely low shives content is of special importance when producing tissue pulp. The extremely high long-fiber content with the corresponding high freenes is of special importance when producing fluff pulp. A further object of the invention is to provide a novel method for the manufacture of absorbent chemithermomechanical pulps at low energy inputs.

The invention thus relates to an absorbent chemithermomechanical pulp produced from lignocellulosic material at a wood yield above 88%, a resin content beneath 0.15%, calculated on the amount of resin which can be extracted in dichloromethane, a high long-fibre content, a low short-fibre content and a low shives content, the pulp being characterized in that when fractionating the pulp according to Bauer McNett, the long-fibre content is above 70%, preferably above 75% of fibres retained on a wire gauze of size 28 mesh and the short-fibre content is beneath 10%, preferably beneath 8%, of fibres which pass through a wire gauze of size 200 mesh according to Bauer McNett; and in that the shive content is lower than 3%, preferably lower than 2%, measured according to Sommerville.

The pulp should have such brightness that it can be bleached at a reasonable consumption of bleaching chemicals to a brightness of at least 65% ISO, preferably 70%. Alternatively the pulp may have been beached to such brightness.

This pulp is particularly well suited for the manufacture of fluff and tissue. W hen the pulp is a fluff pulp it is preferably refined to a freeness of 740 ml at the lowest especially 750 ml at the lowest and suitably 760 ml CSF at the lowest. Such a pulp does not need to be bleached and may have a brightness of at least 45% ISO.

When the pulp is a tissue pulp it has suitably a brightness of at least 65% ISO, preferably above 70%. The tissue pulp does not need to have as high a freenes<as the fluff pulp. Suitably it is refined to a freeness of 650 ml CSF at the lowest.

The problem with manufacturing pulp suitable for fluff and tissue by means of a chemithermomechanical method lies in the desired combination of high freeness, high long-fibre content, low shive content and high brightness. An increase in temperature when preheating will favour the reduction in shive content but, at the same time, impair brightness.

It has now surprisingly been found that a chemithermomechanical pulp having the desired properties can be produced by a) impregnating the chips with sodium sulphite, sodium dithionate, alkaline peroxide or the like, with an addition of a complex builder;

b) preheating the chips;

c) defibering the chips to pulp in a refiner at substantially the same pressure and temperature as those employed in the preheating process; and d) washing and dewatering the pulp to, e.g., a consistency of 25–50%, wherein, in accordance with the invention, impregnation and preheating of the chips is effected in one and the same vessel over a combined treatment time of at most 2 minutes, particularly at most 1 minute, preferably at most 0.5 minute; and a) using a warm impregnating liquid having a temperature of at least 100° C., suitably at least 130° C. and preferably having essentially the same temperature as that of the preheating process;

b) preheating the chips at a temperature of 150–175° C., preferably 160–170° C.; and c) carrying out the defibering process with an energy input which is at most half of the energy input required for defibering to the same shive content in a similar refiner when preheating and defibering are performed at 135° C.

The complex builder used in the impregnating process may, for instance, be DTPA, which contributes to an improvement in pulp brightness.

The pulp may e) be refined to a brightness above 65% ISO, preferably above 70%. To accomplish this at a reasonable consumption of bleaching chemicals the brightness after refining has to be at least 45% ISO, preferably at least 50%. Such bleaching should preferably be performed when the pulp is a tissue pulp.

In order to obtain a pulp of sufficient brightness, it is essential that preheating at the aforesaid high temperature is not permitted to proceed over a period of time of as long a duration as the standard preheating time of about 3 minutes used when producing chemimechanical pulp of CTMP type. In order to enable the preheating time to be lowered to at most 2 minutes, preferably at most 1 minute, it is necessary to use an impregnating solution which is heated to a temperature of at least 100° C., particularly at least 130° C. and preferably substantially to the same temperature as that used in the preheater. Furthermore, no impregnating liquid shall be removed between the impregnating and preheating steps. Consequently, impregnation is effected in the same vessel as that in which the chips are preheated, and at the same pressure and suitably at the same temperature or only a slightly lower temperature. The brightness of the pulp is sustained because of the very short stay time at the high temperature, so that an excessively large quantity of bleaching chemicals, such as peroxide, will not be required in the following bleaching step. Furthermore, the wood yield obtained in this way is almost equal to the wood yield obtained when preheating the chips conventionally at 130–140° C. In addition, when refining to a freeness slightly above 750 ml CSF, the energy input required for the defibering process is reduced from about 600 kWh/tonne at 130° C. to less than 300 kWh/tonne at. 170° C. These values,have been obtained in a pilot plant. Commercial values may differ from those obtained at pilot level. The relative differences between the levels for shives content, brightness and energy input obtained in the pilot plant at conventional temperature and at the temperature according to the invention, respectively, should, however, remain in a commercial plant.

The inventive method suitably includes the conventional steaming, impregnating, preheating, defibering, washing, screening, washing, possibly bleaching, washing and drying stages. Whereas a conventional impregnating process is carried out with cold liquid in a vessel other than the preheating process, which is carried out over a period of about 3 minutes and at a temperature of about 130° C., and in which process impregnating liquid is removed between the impregnating stage and the preheating stage, the impregnating and preheating processes of the inventive method are combined in one and the same vessel and are carried out at the same pressure and substantially the same temperature 100–175° C., 150–175° C. respectively, over a combined time period of at most 2 minutes, suitably at most 1 minute and preferably at most 0.5 minute.

Because preheating is effected at high temperature, the refining process requires less energy. A low energy input will normally result in high freeness and high shive content. A surprising characteristic of the present invention is that at low energy inputs, success is achieved in combining high freeness with low shive content. Low energy input would otherwise result in a high shive content.

When applying the inventive method in tests on a laboratory seal, a freeness of above 780 ml CSF was achieved with an acceptable shive content. In some instances, a freeness of above 800 ml was achieved. This can be compared with a freeness of about 650–750 ml CSF in the normal production of CTMP-fluff.

The pulp is washed subsequent to the refining process, suitably under pressure and at high temperature, preferably while excluding air from the system and in immediate connection with the refining stage. The pulp is dewatered to a consistency of e.g. 25–50%. Possible bleaching is then carried out with peroxide or other bleaching chemical. If desired, the pulp can again be washed, after the bleaching process.

When producing fluff, defibering is carried out to a freeness of 740 ml at the lowest, suitably of 750 at the lowest, preferably of 780 ml CSF at the lowest. When producing tissue pulp the refining may be carried out to a freeness of 650 ml CSF at the lowest.

When applying the inventive method, it is possible to produce pulp with a wood yield above 88%, preferably above 90%, a resin content of less than 0.15%, calculated on the. amount. of resin that can be extracted in dichloromethane, and a brightness above 65% ISO after bleaching.

BRIEF DESCRIPTION OF THE DRAWINGS

The invention will now be described in more detail with reference to the following exemplifying embodiments thereof and with reference to the accompanying drawings, in which.

DETAILED DESCRIPTION OF THE INVENTION

Figure 1:
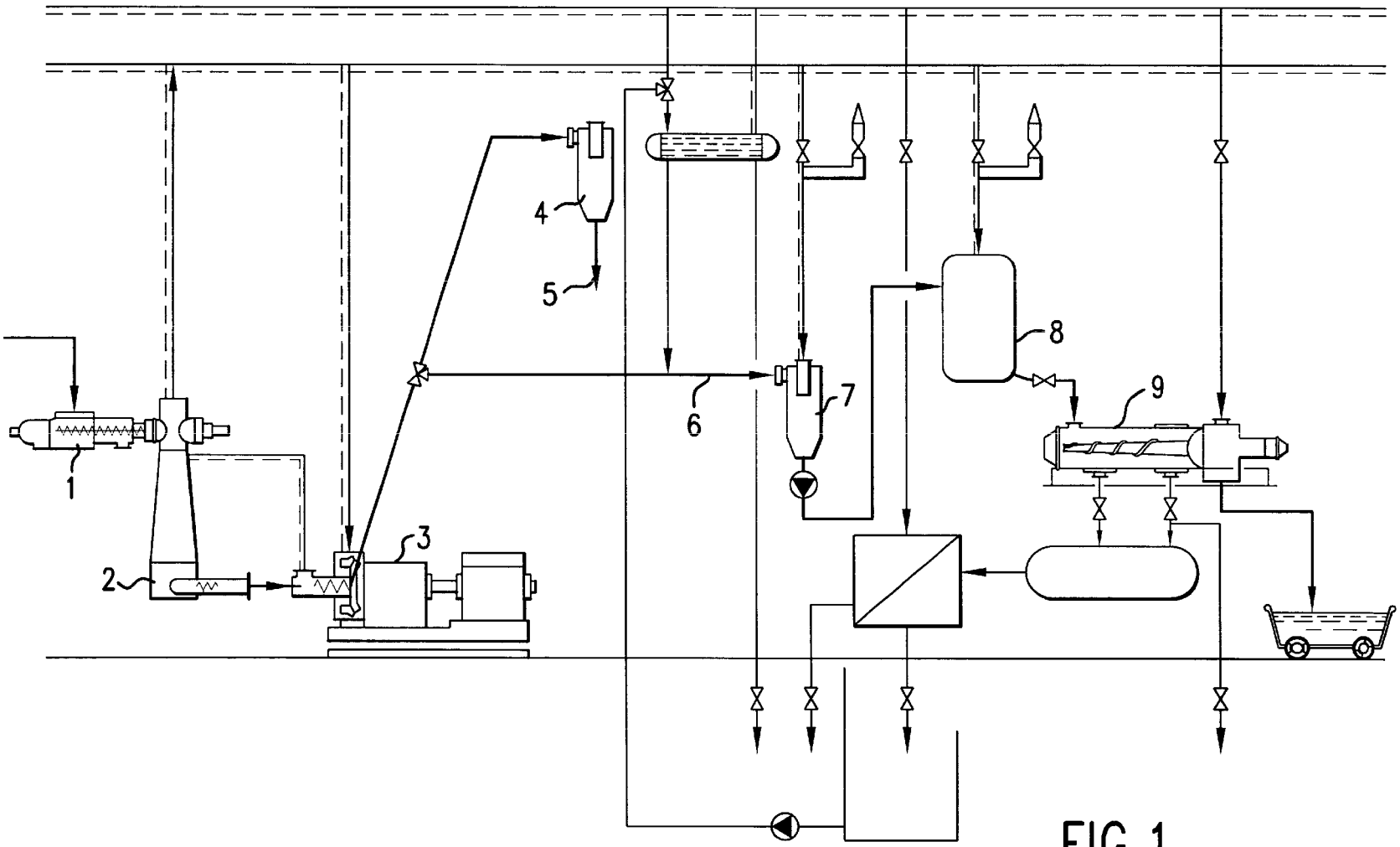
FIG. 1 illustrates schematically a test plant used in the exemplifying embodiments.
Figure 2:
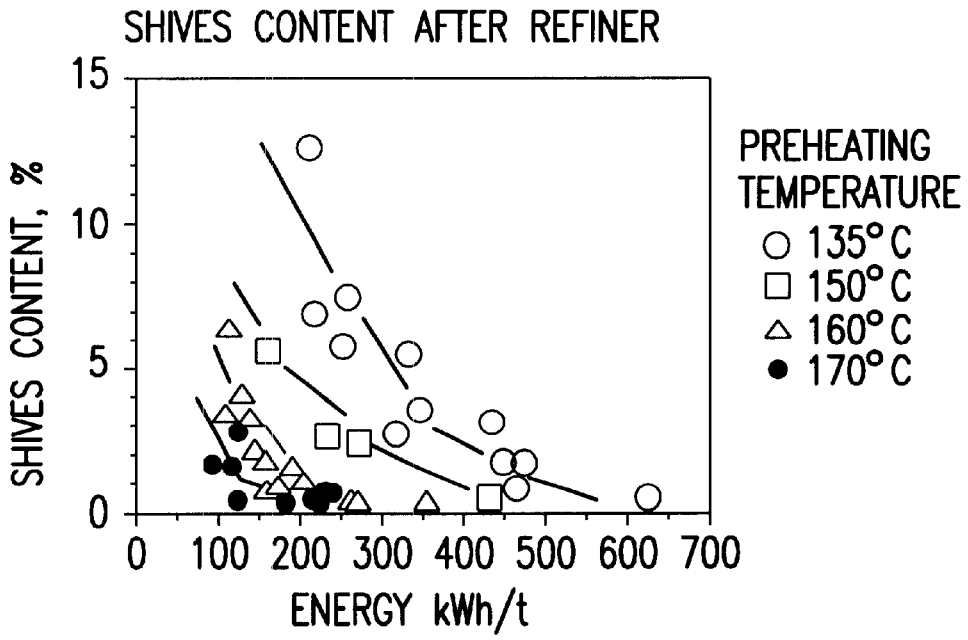
FIG. 2 is a diagram showing shive content against energy input at defibering.
Figure 3:
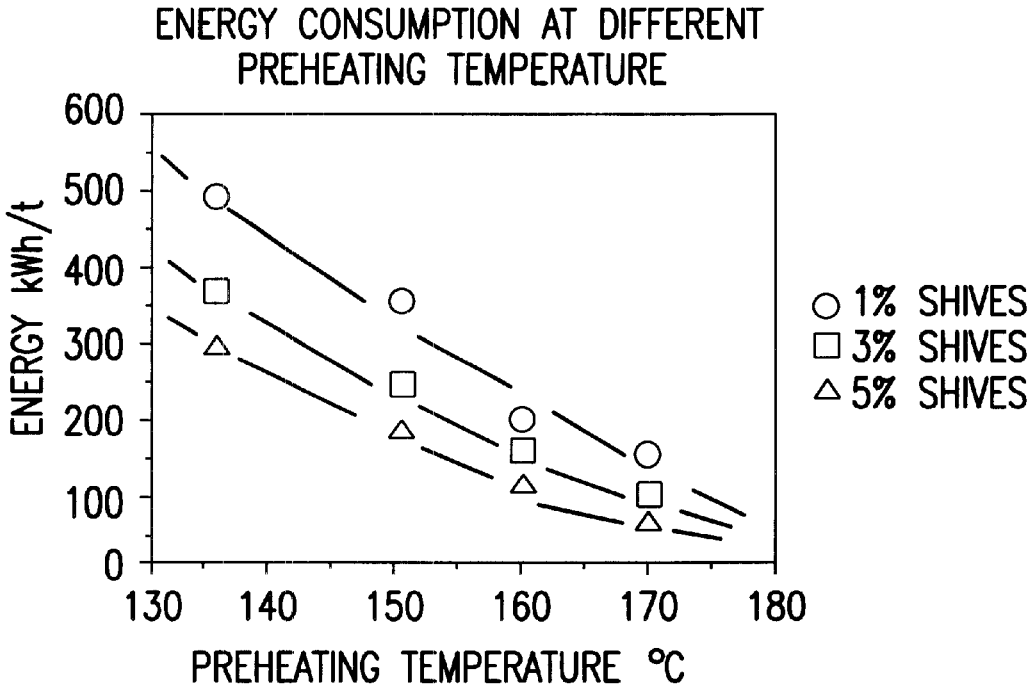
FIG. 3 is a diagram showing energy at defibering against preheating temperature.
Figure 4:
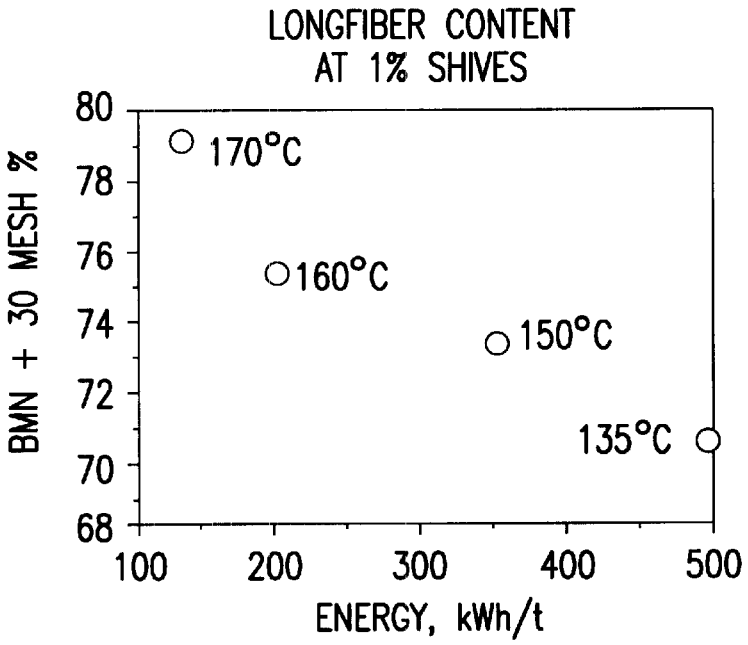
FIG. 4 is a diagram showing long-fibre content against energy input at defibering.
Figure 5:
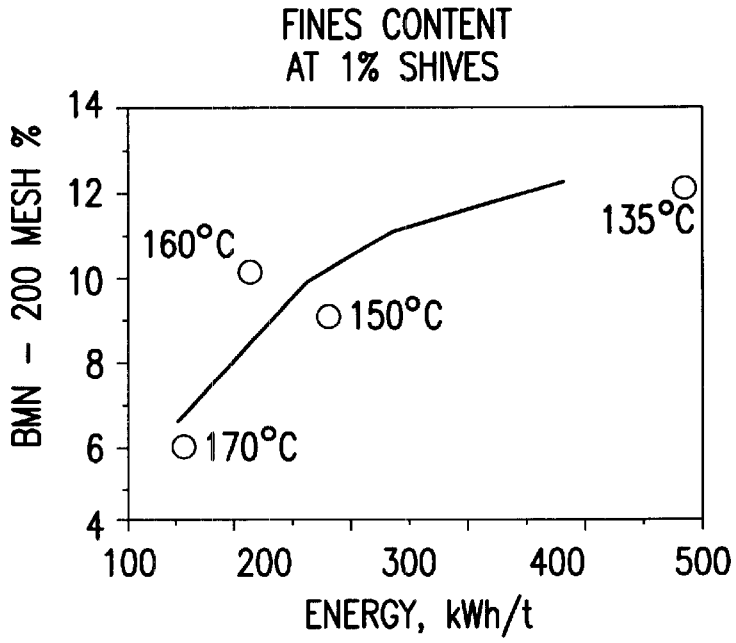
FIG. 5 is a diagram showing short-fibre content against energy input at defibering.
Figure 6:
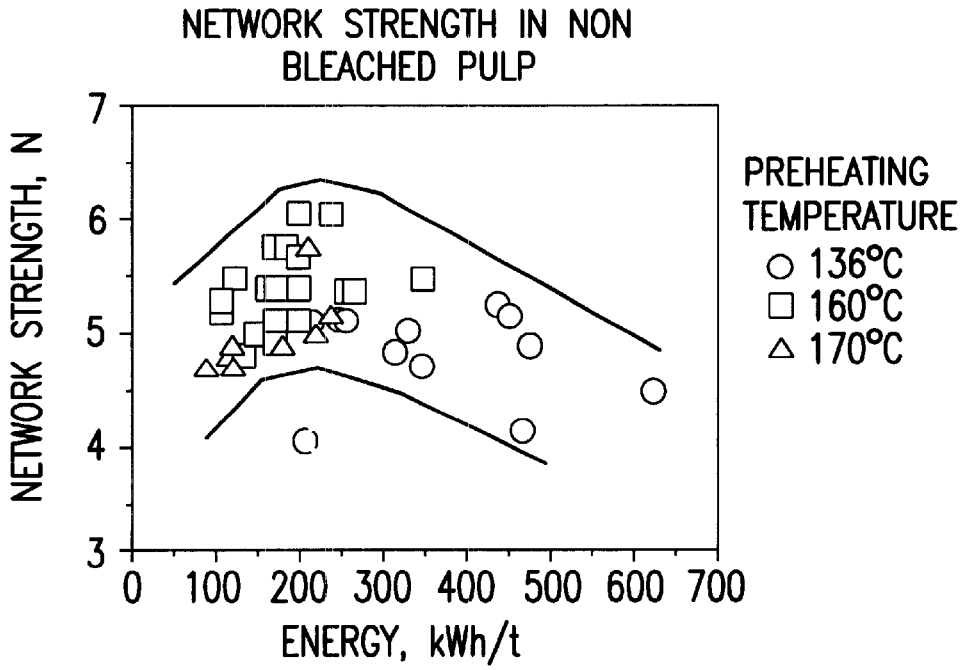
FIG. 6 is a diagram showing network strength against energy input.
Figure 7:
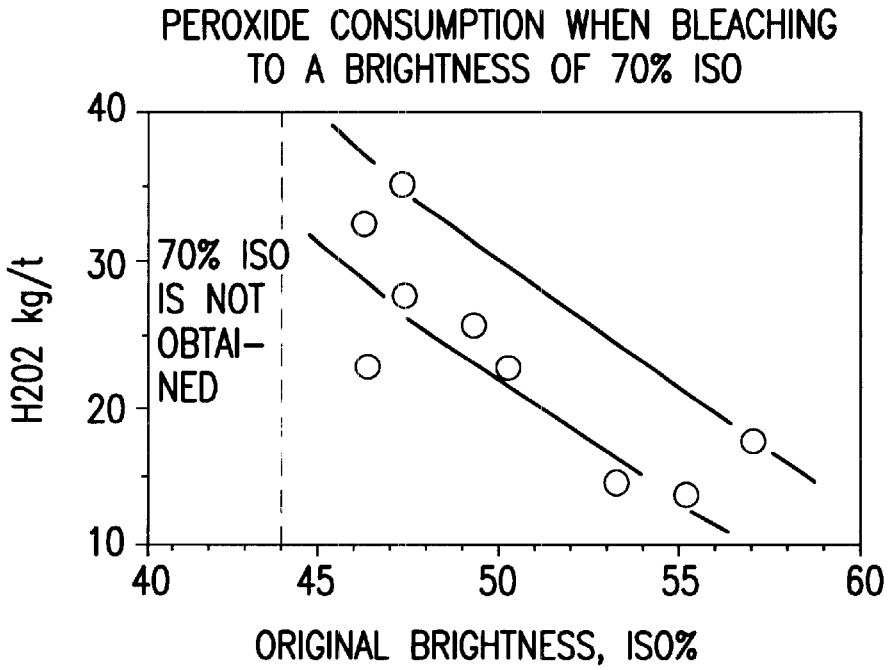
FIG. 7 is a diagram showing peroxide consumption against original brightness after defibering.
Figure 8:
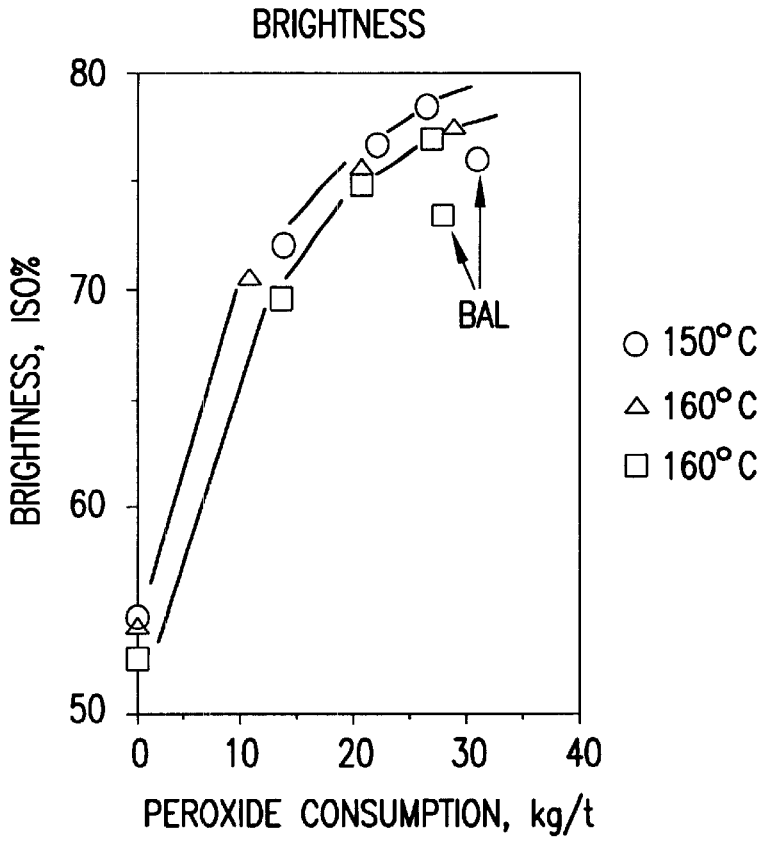
FIG. 8 is a diagram showing brightness after defibering against peroxide consumption.
Figure 9:
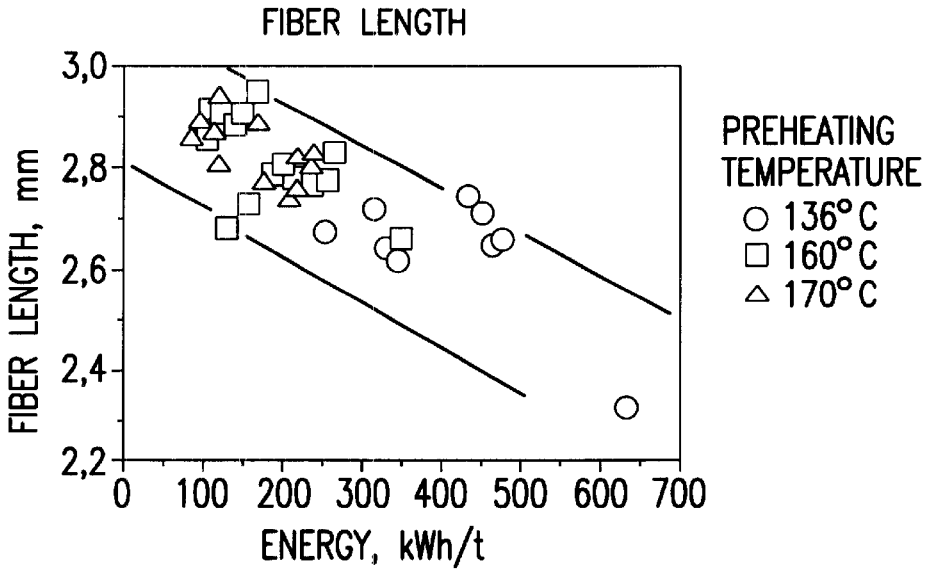
FIG. 9 is a diagram showing fibre length against energy input after defibering.

In order to study the possibility of manufacturing fluff and tissue pulp in a high-temperature variant of a CTMP-process, there was used a test plant schematically illustrated in FIG. 1. The plant was constructed so that the pulps could be washed in immediate connection with refining at high temperature.

The chips are introduced into the preheater 2 with the aid of the feed screw 1 and are impregnated at the preheater inlet. The preheated chips are then passed immediately to the refiner 3, where the chips are defibered while supplying water. When starting-up the plant, and when samples shall be taken immediately after the refining stage, the resultant pulp is passed to the cyclone 4 where samples can be taken in the direction of arrow 5. The connecting line to the cyclone 4 is then disconnected and the blower line 6 connected instead, such as to thin the pulp to a consistency of about 3% during transportation to a vessel 7 equipped with a pump which functions as a mixer. The pulp is then pumped to a level vessel 8 which is connected directly to a screw press 9. The entire system, from impregnation to dewatering in the screw press, can be pressurized to 1 MPa.

Spruce sawmill chips were used in the tests. The chips were screened on two different screens, to remove excessively coarse chips and sawdust. The screens had a hole diameter of 35 mm and 8 mm respectively. The chips were impregnated with 50 kg sodium sulphite and 3 kg DTPA per tonne of chips in all tests, prior to the preheating, refining and washing stages.

EXAMPLE

Chips were treated in the plant shown in FIG. 1 at different temperatures during the preheating-refining process. The temperature was allowed to vary between 135 and 170° C. The impregnating liquid was subjected to a heat exchange and brought to the temperature level of the preheater. At each temperature level in the refiner, the pulp was washed at a temperature of about 10° C. beneath the preheated temperature and at a temperature of about 90° C. under atmospheric pressure. The stay time in the preheater was maintained as constant as possible over a period of about 1 minute.

Subsequent to impregnation with the same chemical input as that used for remaining pulps, a CTMP-pulp was produced in an OVP-20 (Open Vertical Preheater) at a preheating and refining temperature of 135° C., this pulp being used as a reference pulp.

The results of the tests carried out on the pulps are shown partly in FIGS. 2–9 and in the following Table. These show typical results obtained in this pilot plant for some of the parameters of interest for the invention. The following Table I shows some of the results obtained.

TABLE I

| Manufacture | Reference Conventional CTMP Factory scale | High Temperature CTMP Pilot plant manufacture in the plant shown in FIG. 1 | | | |
|---|---|---|---|---|---|
| Preheating temperature ° C. | 135 | 135 | 150 | 160 | 170 |
| Preheating time, min. | 3 | 1 | 1 | 1 | 1 |
| Refining energy consumption kWh/ton | 700 | 450 | 350 | 210 | 150 |
| Freeness (CSF), ml | 725 | 745 | 735 | 745 | 755 |
| Shive content Somerville, % | 3.0 | 1.4 | 0.6 | 0.8 | 0.5 |
| Long fibre (BMN > 30 mesh), % | 69 | 71 | 81 | 77 | 77 |
| Fine material (BMN < 200 mesh), % | 10 | 9 | 3 | 7.5 | 7.5 |
| Weighed mean fibre length according to Kajaani, mm | 2.50 | 2.65 | 2.74 | 2.85 | 2.85 |
| Brightness prior to H2O2-bleaching, % | — | 55 | 58 | 50 | 45 |
| DKM-extract prior to bleaching and final washing, % | — | 0.22 | 0.24 | 0.26 | 0.25 |

Tests were also carried out at laboratory level in a 10 litre digester. The chips were steamed at atmospheric pressure and then impregnated with a weak alkaline sulphite solution before the pressurized steam treatment at high temperature. p500 g of spruce chips with a dry solids content of 48.1% were steamed at a temperature of 100° C. over a period of 2 minutes. The impregnating solution contained 20 g/l sodium. sulphite and 3.2 g/l DTPA and had a temperature of 100° C. The impregnation was carried out for 1 minute under a nitrogen pressure of 7 bar. After removal of excess impregnating solution the chips were heated to their respective heating temperatures as fast as possible. Condensate was drained while heating. The time at each temperature was varied. Thereafter the chips were cooled in cold water. These chips were then refined and tested for brightness.

Figure 10:
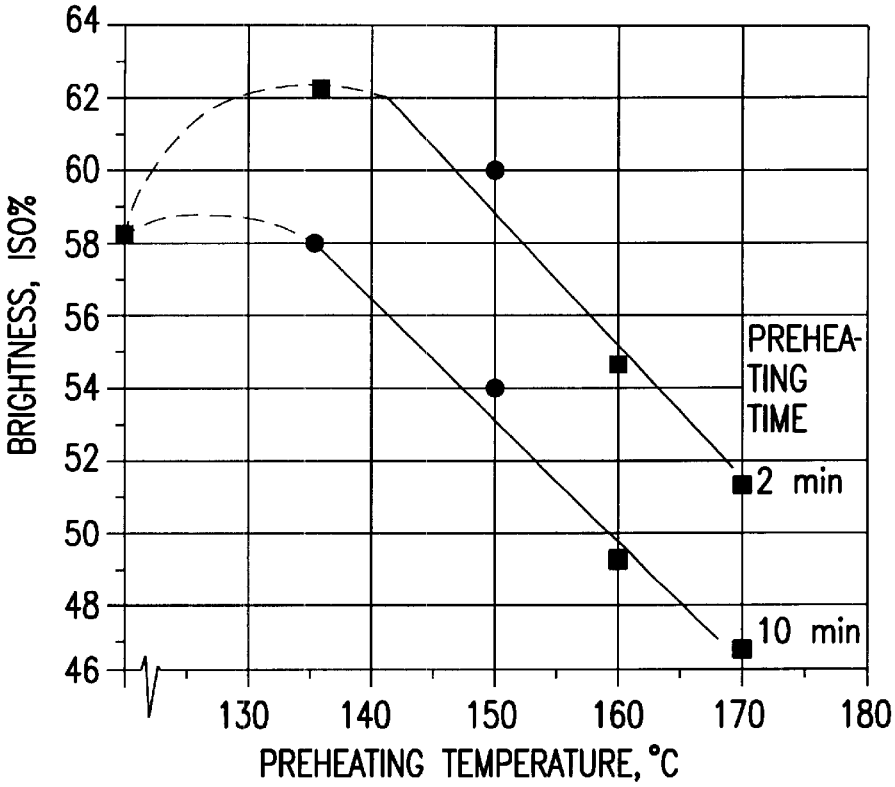
FIG. 10 is a diagram showing the brightness obtained after defibering against preheating temperature.
Figure 11:
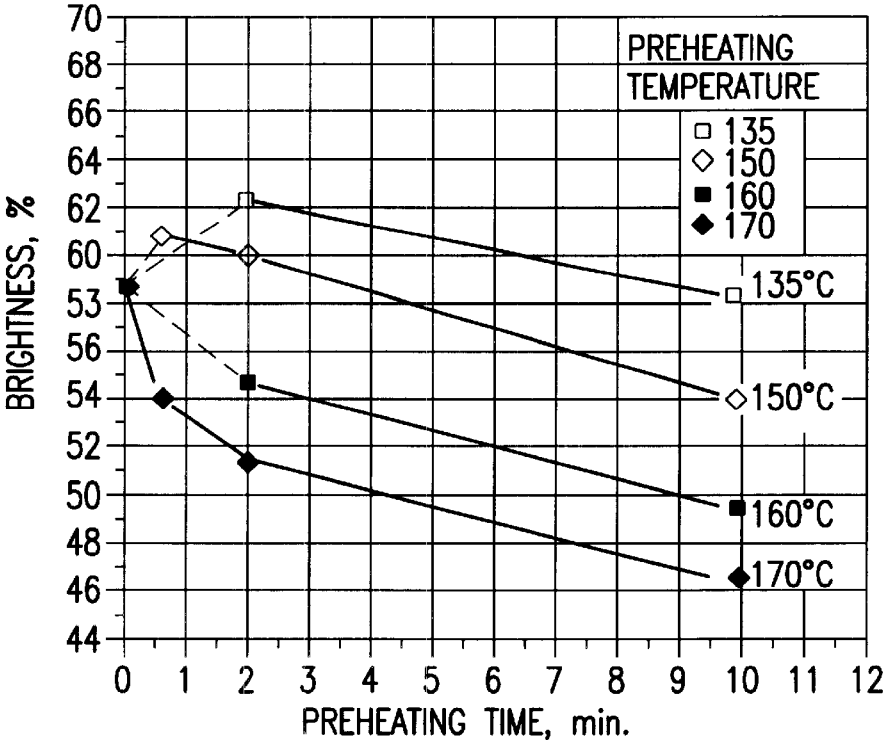
FIG. 11 is a diagram showing brightness after defibering against preheating temperature.

The results obtained are shown in the following Table II and on the FIGS. 10 and 11.

TABLE II

| Analysis Data | | | |
|---|---|---|---|
| Preheating temperature ° C. | Preheating time, min. | Sample K 21/90 | Brightness % ISO |
| | | 0 | 58.3 |
| | | $O_1$ | 58.3 |
| 135 | 2 | $A_2$ | 62.6 |
| | 10 | $A_5$ | 58.2 |
| 150 | 1/2 | $B_1$ | 60.7 |
| | 2 | $B_2$ | 60.0 |
| | 10 | $B_5$ | 54.1 |
| 160 | 2 | $C_2$ | 54.5 |
| | 10 | $C_5$ | 49.5 |
| 170 | 1/2 | $D_1$ | 54.1 |
| | 2 | $D_2$ | 51.3 |
| | 10 | $D_5$ | 46.6 |

What is claimed is:

1. An absorbent chemithermomechanical pulp produced from lignocellulosic material consisting of wood chips at a wood yield above 88%, by a process comprising a) steaming the wood chips;

b) impregnating the chips with a warm impregnating solution having a temperature of at least 130° C., and selected from the group consisting of sodium sulphite, sodium dithionate and alkaline peroxide, with an addition of a complex building;

c) preheating the chips at a temperature of 150–175° C.;

d) carrying out steps b) and c) in one and the same vessel over a combined time period of at most 2 minutes by impregnating the chips with said impregnating solution;

e) defibering the chips to pulp at substantially the same pressure and temperature as those employed in the preheating process; and f) washing and dewatering the pulp, said pulp having a resin content below 0.15%, calculated as the amount of resin that can be extracted in dichloromethane, a high long-fibre content, a low-short-fibre content and a low shives content, said pulp further having such a brightness that it can be bleached with peroxide to a brightness of at least 65% ISO, wherein when fractioning according to Bauer McNett, the long-fibre content is above 75% of fibers retained on a wire gauze of size 28 mesh and the short fibre content is below 8% of fibers which pass through a wire gauze of size 200 mesh; and wherein the shive content is lower than 3% measured according to Somerville, and said pulp being a fluff pulp having been refined to a freeness of 760 ml CSF at the lowest.

2. A pulp according to claim 1, wherein the long fibre content is above 78% and the short fibre content is below 6%.

3. A pulp according to claim 1, wherein the shive content is lower than 2%.

* * * * *